US009113764B2

(12) United States Patent
Theising

(10) Patent No.: US 9,113,764 B2
(45) Date of Patent: Aug. 25, 2015

(54) VACUUM FILTER BAG MOUNTING APPARATUS AND METHODS OF OPERATION

(71) Applicant: John L. Theising, St. Peters, MO (US)

(72) Inventor: John L. Theising, St. Peters, MO (US)

(73) Assignee: EMERSON ELECTRIC CO., St. Louis, MO (US)

( * ) Notice: Subject to any disclaimer, the term of this patent is extended or adjusted under 35 U.S.C. 154(b) by 0 days.

(21) Appl. No.: 14/317,913

(22) Filed: Jun. 27, 2014

(65) Prior Publication Data

US 2015/0040343 A1 Feb. 12, 2015

Related U.S. Application Data

(60) Provisional application No. 61/865,040, filed on Aug. 12, 2013.

(51) Int. Cl.
*A47L 9/14* (2006.01)

(52) U.S. Cl.
CPC ..... *A47L 9/1445* (2013.01); *A47L 9/1472* (2013.01)

(58) Field of Classification Search
CPC ... A47L 9/1445; A47L 9/1454; A47L 9/1418; A47L 9/1427; A47L 9/1683; A47L 9/127; A47L 5/28
See application file for complete search history.

(56) References Cited

U.S. PATENT DOCUMENTS

| | | | | |
|---|---|---|---|---|
| 1,553,076 | A | 9/1925 | Halsted | |
| 2,742,105 | A * | 4/1956 | Dow | 96/404 |
| 3,519,163 | A | 7/1970 | Bardell | |
| 3,665,683 | A | 5/1972 | Schaefer | |
| 4,185,976 | A * | 1/1980 | Kosik et al. | 55/373 |
| 4,256,240 | A | 3/1981 | Woinarski | |
| 4,589,894 | A | 5/1986 | Gin et al. | |
| 4,800,614 | A | 1/1989 | Kopco et al. | |
| 5,028,245 | A | 7/1991 | Stein et al. | |
| 5,057,131 | A | 10/1991 | Lackner et al. | |
| 5,089,038 | A * | 2/1992 | Kopco et al. | 55/374 |
| 5,240,484 | A | 8/1993 | Genovese et al. | |
| 5,538,154 | A | 7/1996 | Von Holdt | |
| 5,544,385 | A | 8/1996 | Jailor et al. | |
| 5,755,009 | A * | 5/1998 | Stephens et al. | 15/347 |
| 5,855,634 | A | 1/1999 | Berfield | |
| 6,230,924 | B1 | 5/2001 | Weiss et al. | |
| 6,260,729 | B1 | 7/2001 | Mitchell et al. | |
| 6,451,078 | B2 | 9/2002 | Berfield et al. | |
| 6,802,879 | B2 | 10/2004 | Scanlon | |
| 7,011,228 | B2 | 3/2006 | Ordiway | |
| 7,254,865 | B2 * | 8/2007 | Bosses | 15/327.2 |
| 7,332,005 | B2 * | 2/2008 | Wegelin | 55/373 |
| 7,799,107 | B2 * | 9/2010 | Corney et al. | 55/367 |
| 7,918,360 | B2 | 4/2011 | Mengeu et al. | |
| 8,075,650 | B2 | 12/2011 | Hale | |

(Continued)

FOREIGN PATENT DOCUMENTS

| | | |
|---|---|---|
| EP | 1139843 | 5/2005 |

*Primary Examiner* — Dung Van Nguyen
(74) *Attorney, Agent, or Firm* — Sutton McAughan Deaver PLLC

(57) ABSTRACT

The present invention is an improved vacuum filter or collection bag assembly for vacuum cleaners and other appliances, particularly upright vacuum cleaners. The filter bag assembly includes a filter bag with a sealing and locking rim assembly which mates with a section of the vacuum filter housing, so as to ensure proper seating and minimization of dust and dirt escaping from the filter bag during vacuum operation. The assembly may also include a gasket ring for additional sealing.

20 Claims, 13 Drawing Sheets

(56) References Cited

U.S. PATENT DOCUMENTS 8,186,533 B1 5/2012 Tseng
2010/0263328 A1 10/2010 Dorsey et al.
2012/0193358 A1 8/2012 Billado, Jr.

* cited by examiner

VACUUM FILTER BAG MOUNTING APPARATUS AND METHODS OF OPERATION

CROSS REFERENCE TO RELATED APPLICATIONS

This application is a non-provisional application of U.S. Application Ser. No. 61/865,040, filed Aug. 12, 2013, entitled "Vacuum Filter Bag Mounting Apparatus and Methods of Operation", the entirety of which is incorporated herein by specific reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to collection bags for use with appliances, such as vacuum cleaners, and more specifically is related to vacuum filter bag assemblies with mounting and sealing assemblies that allow for rapid and easy exchange when the filter bag is full.

2. Description of the Related Art

Most upright vacuum cleaners utilize a paper or other material filter bag with a plastic or cardboard attachment mechanism to secure it to the filter housing. Such filter bags have been mounted inside a vacuum cleaner housing for capturing dirt and dust entrained in the air flow from a dirt collecting nozzle. Typically, the dirty air is delivered by a conduit to an enclosed rigid housing or flexible bag in which the dirty air is directed. In some upright vacuum cleaners, the dirty air is drawn or forced through a rigid housing in which the air is filtered. In other upright vacuum cleaners, the dirty air is forced under pressure into a flexible cloth bag which filters the air. Disposable paper or other suitable material bags can be mounted to outlet tubes in the flexible cloth bags and the rigid housings to collect the dust and dirt. A typical filter bag has an aperture formed therein for receiving the dirt and dust from the working air channel.

Several problems have been associated with previous upright vacuum cleaner bag mounting assemblies, including are the cost and complexity of the bag mounting system and the difficulty average consumers experience in properly installing the bag. A challenge faced by the industry is designing a cost-effective filter bag mounting which is intuitive to the customer for mounting the bag on the dirty air outlet housing and which can be quickly and easily installed by the average consumer. Several of the known prior art upright filter bag mounting systems are complex, relatively expensive to manufacture, are not intuitive to the customer or are not reliably alignable. For example, several upright vacuums use a paper filter bag with a cardboard sleeve that can readily be misaligned during installation, leading to dust and dirt to escape from the bag around the seals during use.

The inventions disclosed and taught herein are directed to improved vacuum filter assemblies with a locking rim to secure and seal the filter in place and minimize filter leakage after installation.

BRIEF SUMMARY OF THE INVENTION

The objects described above and other advantages and features of the invention are incorporated in the application as set forth herein, and the associated drawings, related to systems for improved vacuum filter sealing assemblies.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
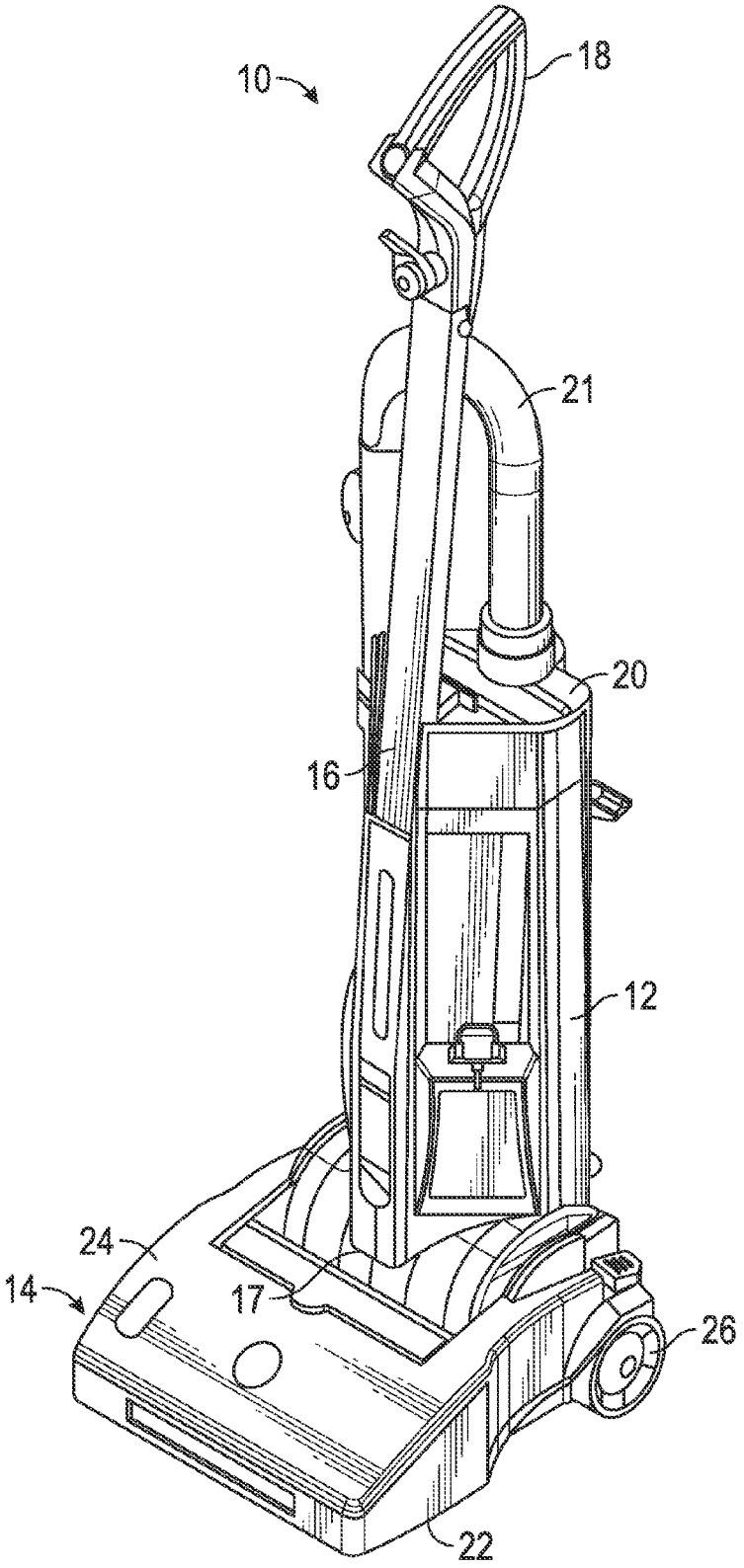
FIG. 1 illustrates a perspective view of an exemplary upright vacuum cleaner having a filter bag receptacle within a housing.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created a filter closure system for use with upright vacuum cleaners.

Turning now to the figures, and to FIG. 1 in particular, an upright vacuum cleaner 10 comprises a floor-engaging foot 14 and an upwardly-extending handle assembly 16 pivotally mounted thereto. Although the description of the invention relates to an upright vacuum cleaner, the concepts embodied in this invention can also be applied to canister vacuum cleaners and other suction-powered cleaners. A filter bag housing compartment 12 is mounted to the handle assembly 16 which preferably comprises a housing molded from a rigid material, such as a synthetic resin. A flexible hose 21 and an accessory wand 22 are removably mounted to the upright vacuum cleaner 10 for typical above-the-floor cleaning operations. The foot 14 can also be pushed along a floor surface on wheels 26 which are rotatably mounted to the foot 14.

The foot 14 comprises a cover 24 typically removably mounted to a base pan 22, which cooperate to receive the wheels 26 for rollably supporting a rear portion of the vacuum cleaner 10. One or more lift wheels (not shown) are typically provided at a central portion of the base pan 22 and are adapted to lift a front portion of the foot 14 away from the floor surface when the handle assembly 16 is moved to an upright position. A mechanism for manually adjusting the operating height of an agitator brush (not shown) with respect to the floor surface can also be provided to adapt the vacuum cleaner 10 to optimally clean a variety of floor surfaces, such as a bare floor, thin carpet, shag carpet, etc.

The handle assembly 16 comprises a handle base 17, a central fill tube, and a handle 18 opposite the handle base 17. These components are preferably formed as rigid components formed from a synthetic resin or other suitable polymeric material. The handle base 17 is preferably pivotally mounted to the foot 14 which fluidly communicates with a suction passage (not shown) which extends forwardly in the foot 14 to the agitator brush so that loosened debris travels through the suction passage and into the handle base 17.

The fill tube includes housing 12 which defines an internal bag receiving chamber. The bag compartment housing includes an upper housing cap 20 and preferably comprises a spout (not shown) which cooperates with an air-flow conduit within the vacuum assembly 10 and retaining means adapted to removably mount a filter bag within the bag receiving chamber of housing 12, as will be discussed in more detail herein. The filter bag typically comprises a porous container having a plate with an aperture provided therein. The aperture of the filter bag associates and communicates with the spout so that the conduit is fluidly interconnected with the interior of the container.

Figure 10:
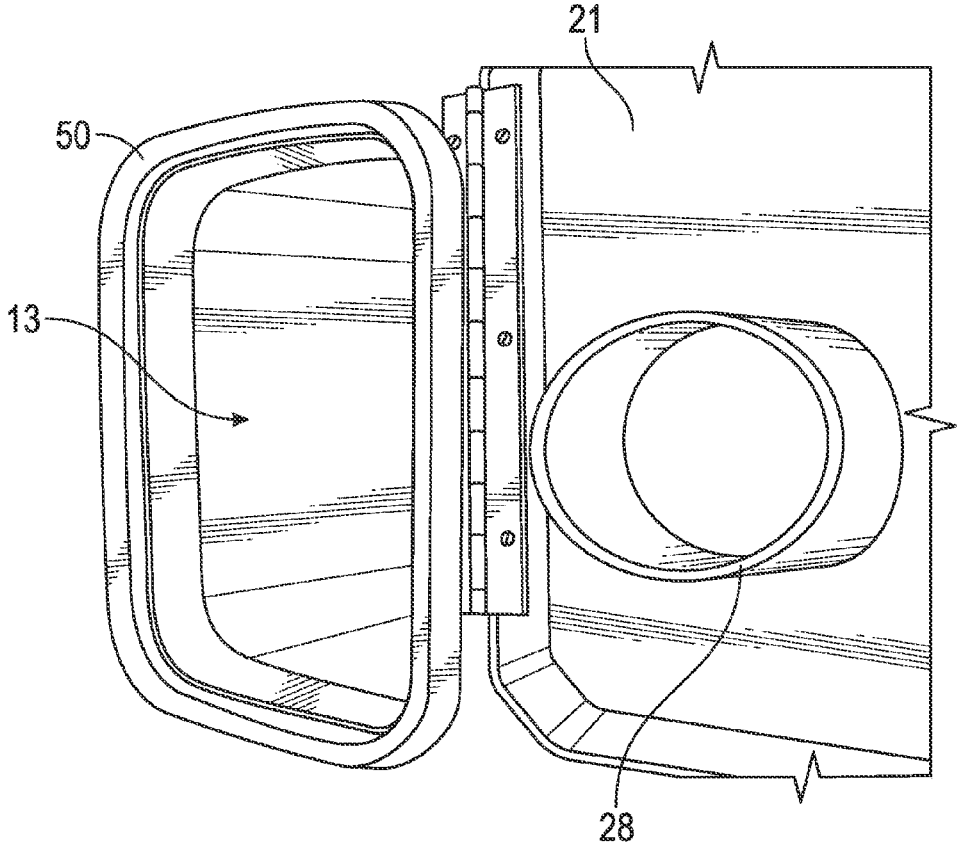
FIG. 10 illustrates an exemplary interior view of a vacuum bag containment chamber of a vacuum cleaner, in accordance with aspects of the present disclosure.

In operation, the motor (not shown) rotates an impeller fan (not shown) which draws dirt and other debris-laden air through a nozzle opening formed on the bottom surface of the foot 14. The dirt laden air is conveyed from the nozzle opening to the impeller fan housing through a working air channel of the foot 14. A rotating fan further forces the dirt laden air stream through an exit aperture of the fan housing and into the working air channel of the handle 16. The air passes through the working air channel and out an outlet tube 28 extending downward from an inner face 21 of the upper housing cap 20, and into a filter bag located within the generally hollow interior 13 (FIG. 10) of housing 12. The filter bag, as will be described further herein, is air permeable and filters most of the dirt, dust, and debris from an air stream passing therethrough. Dirt, dust and other solid debris is then retained in the filter bag with the air passes through the filter bag and through an optional outer bag to the external environment. As will be described in more detail below, the bag 32 is associated with the vacuum by a bag mounting member 50 by way of filter assembly 30.

Figure 2:
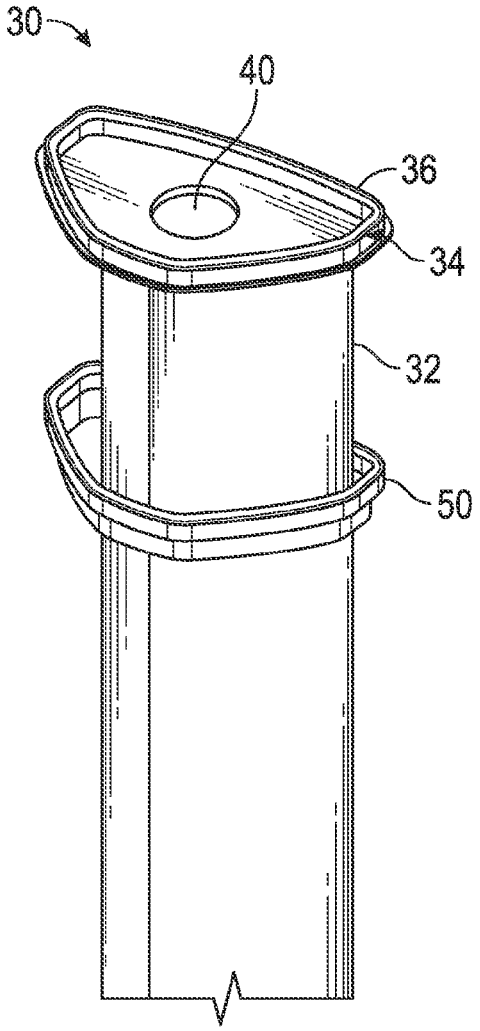
FIG. 2 illustrates an exploded view of an exemplary filter bag assembly in accordance with an embodiment of the present disclosure.
Figure 3:
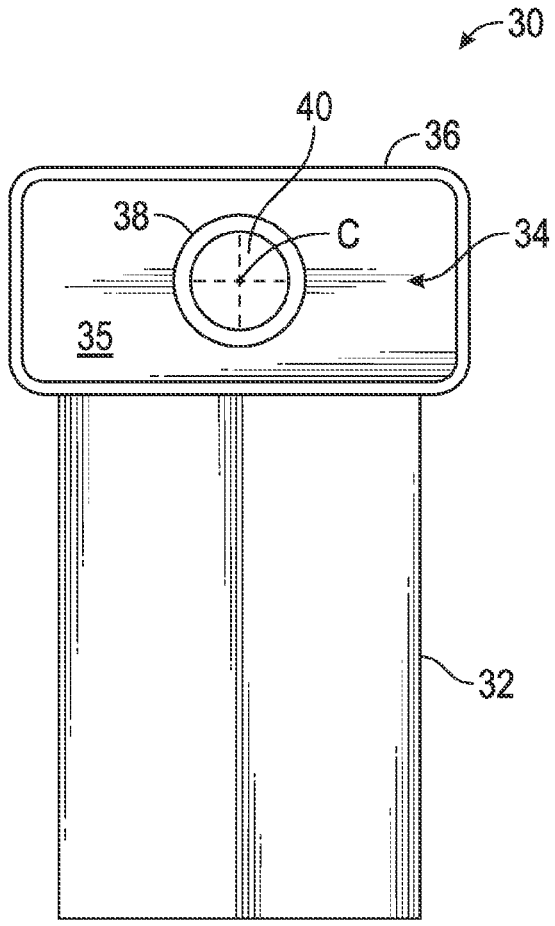
FIG. 3 illustrates an alternative aspect of the embodiment shown in FIG. 2.
Figure 4:
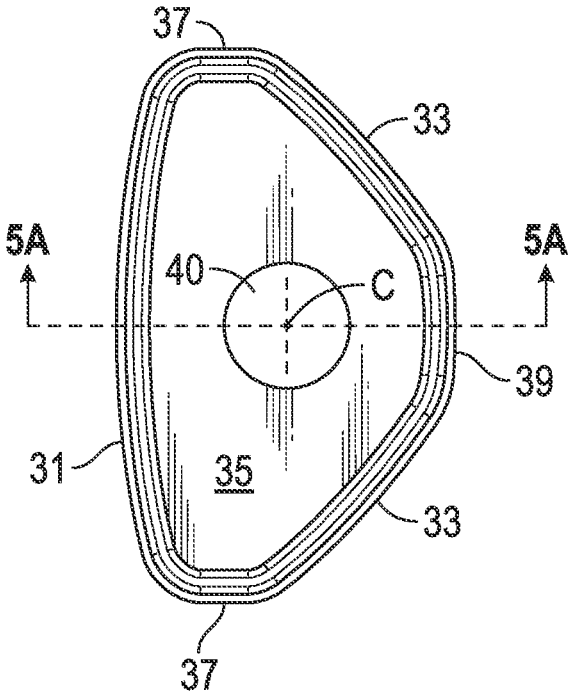
FIG. 4 illustrates a top, planar view of the filter bag assembly of FIG. 2.

FIG. 2 is a perspective view of a filter assembly for use with a vacuum appliance in accordance with the present disclosure. FIG. 3 is a plan view of an alternative embodiment of the filter assembly of FIG. 2. FIG. 4 is a top view of a filter lid assembly. FIG. 5 is a partial cross-sectional view of the filter lid assembly of FIG. 4, taken along line A-A. These figures will now be discussed in association with each other.

Figure 11:
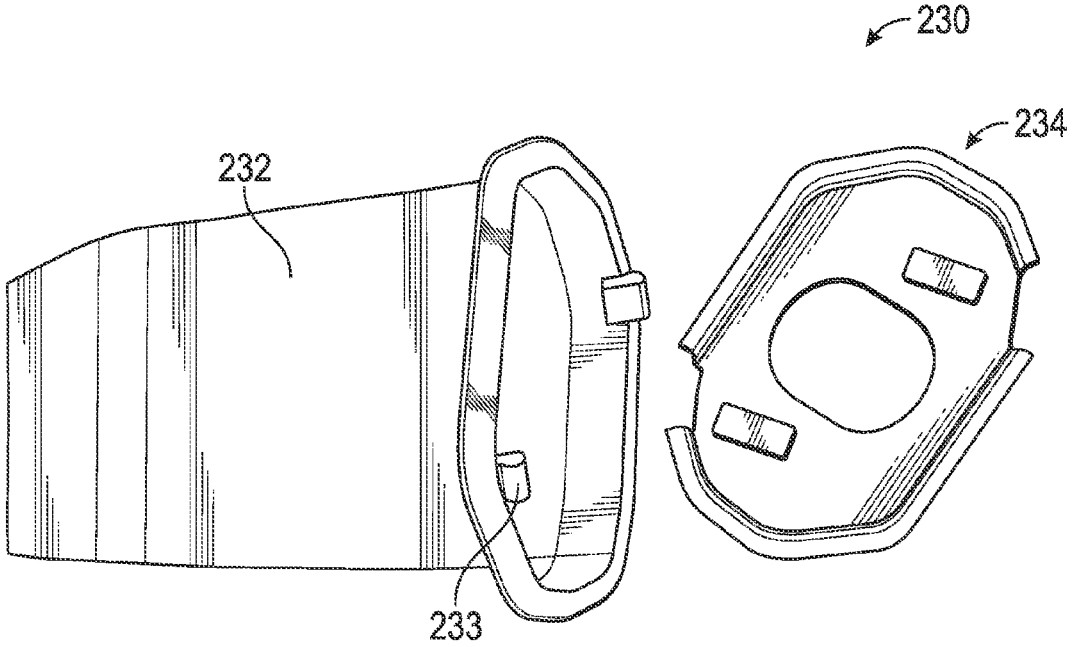
FIG. 11 illustrates a perspective view of an embodiment of a filter bag assembly in accordance with certain aspects of the present disclosure.

As shown in FIG. 2, an exemplary filter assembly 30 in accordance with the present disclosure includes a filter bag 32 having an upper open end and an opposite, lower end. Attached to the upper end of the filter bag 32 is shaped lid 34 having a shaped rim, or closure, 36 and a planar, top wall structure with top and bottom opposite faces. Bag 32 may be attached to the lid 34 by any suitable attachment method, including glue or other suitable adhesives, mechanical attachment means. Rim 50, which will be discussed in more detail below, is associated with, and attached to, the upper rim region of filter compartment housing 12 to retain the bag 23 therein. Near the general center C of the lid 34 is a shaped opening 40 for fluid communication of the vacuum air carrying debris into the filter bag 32. An optional gasket, or sealing member 38 may circumscribe the opening 40 for purposes of enhancing the seal of the filter assembly 30 to the outlet tube of the vacuum cleaner. While the filter assembly 30 is shown to be a generally triangular shape (having at least three elongated edges), the embodiment illustrated in FIG. 3 shows that the assembly 30 may be of any appropriate shape (generally rectangular is shown), the shape being defined by the shape of the filter compartment housing of the vacuum cleaner to which it is associated. For example, and without limitation, as best shown in the top view of the filter assembly 30 in FIG. 4, the lid 34 can include a "long" back wall 31 and two side walls 33 inclined inwardly from back wall 31 toward front wall 39, front wall 39 being generally parallel with back wall 31. The side walls 33 can meet back wall 31 directly, or may taper to the back wall 31 through bridging walls 37 that may be shorter than both the side walls 33 and the back wall 31. Other suitable shapes include circular or oval, without limitation and as appropriate. For example, the lid 34 can be octagonal, or an elongated octagonal shape, as shown in FIGS. 11 and 12.

Figure 5A:
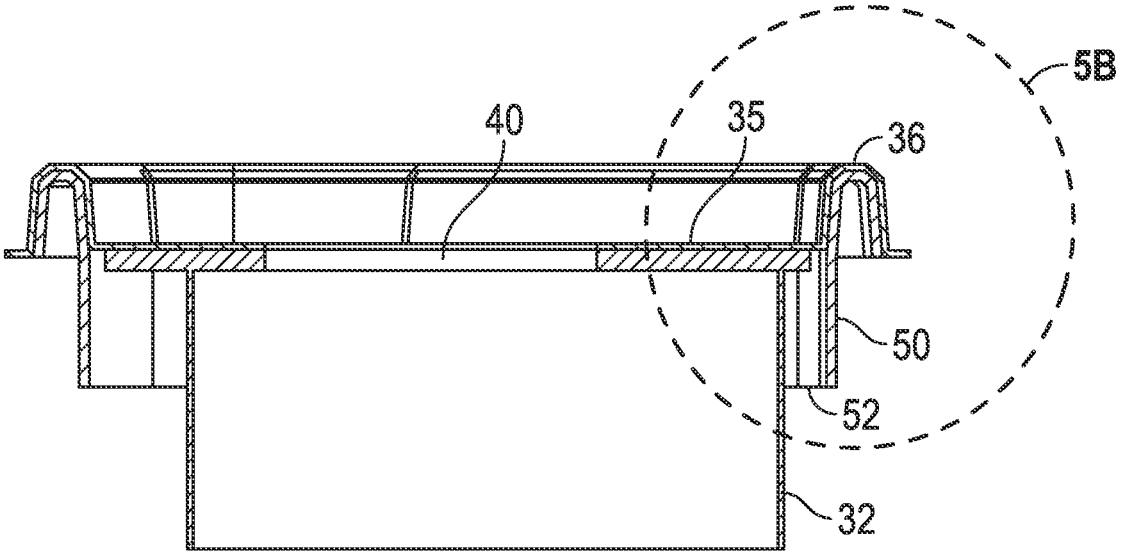
FIG. 5A illustrates a cross-sectional view of the filter assembly of FIG. 2, taken along line A-A of FIG. 4.
Figure 5B:
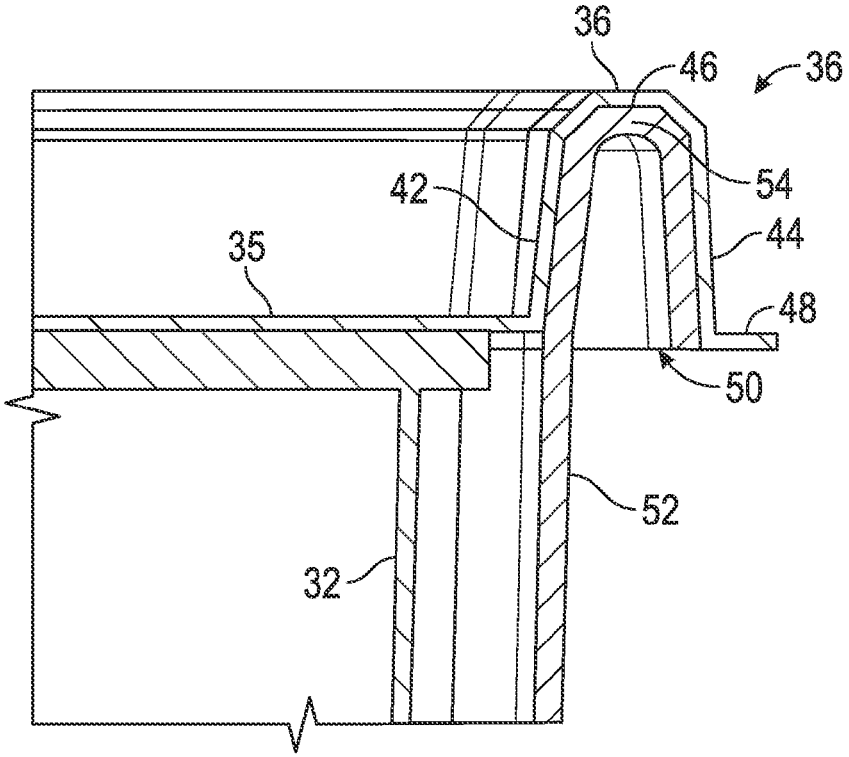
FIG. 5B illustrates a sectional, elevation view of the assembly in FIG. 5A, encircled and identified by the arrow B.
Figure 5C:
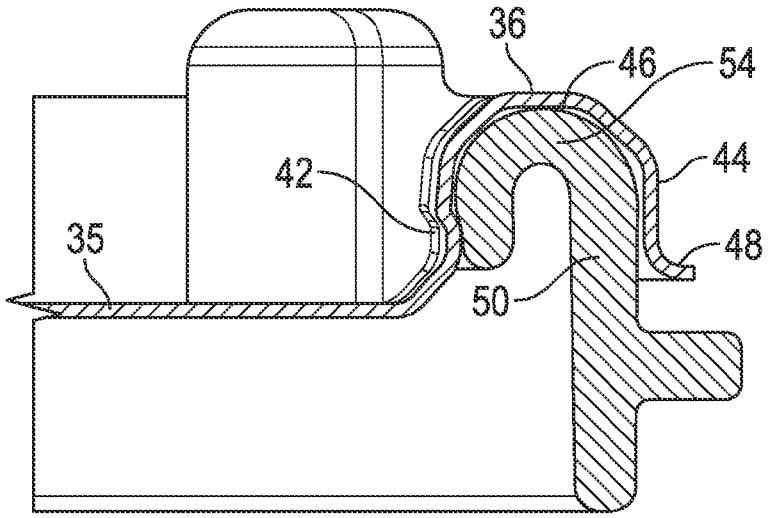
FIG. 5C illustrates a sectional, elevation view of alternative filter bag assembly in accordance with an embodiment of the present disclosure.

FIG. 5A is a cross-sectional view of the top view of FIG. 4, taken along line A-A. FIG. 5B is a close-up sectional, elevational view of the assembly of FIG. 5A, encircled by circle B. The top surface 35 of lid 34 has a surrounding closure 36 circumscribing the outer periphery of the surface. The closure 36 comprises a radial inner wall 42 and an opposite radial outer wall 44, together forming a channel 46 having an inverted U-shape. The channel 46 is continuous, in the sense that its walls 42 and 44 completely encircle the outer periphery of the top surface 35 of lid 34. The outer wall 44 may further include an annular, outwardly-directed projection 48. Rim 50 is attached to the upper periphery of the surrounding walls 52 of housing 12, and has a generally inverted, U-shaped upper edge 54. Upper edge 54 is shaped such that it engages with and fits within the channel 46 in closure 41. The filter assembly 30 may include a gasket (not shown) that closes the gap between the two components (the top closure 36 and the rim 50) in an essentially leak-proof manner, such as by fitting within the channel 46. On some assemblies, the inner wall 42 locks in an inside rim of the upper edge 54. In operation, removal of the lid 34 from the rim 50 is effected by lifting the projection 48 upwardly with respect to the top edge of the rim 50 of container 12 so as to separate the upper edge 54 of the rim from the channel 46 of the closure 36 of the lid, this operation being accommodated by the inherent resiliency of the closure material.

The rim 50 is molded in the shape of upper edge the filter compartment 12, and is attached to the upper rim of the filter compartment 12. The vacuum cleaner bag 32 attached to the lid assembly 36 is preferably made of an air permeable medium having an interior cavity for storing collected debris, as described above. In accordance with other aspects of the invention, the bag 32 is made of an impermeable media having an interior cavity for storing the debris collected by the vacuum cleaner 10. Suitable medias include but are not limited to, paper or a material that includes paper filter media material. However, and in accordance with the present disclosure, other suitable materials that the bag 32 can be made of include any materials that prevent or reduce the airflow of the vacuum, such as polyethylene, polypropylene, vinyl, nylon, coated fabric, coated paper, or other natural or synthetic materials. The thickness of the bag media can vary from a completely flexible material that allows inflation of the bag under use to a rigid material that has a firm shape that exhibits only minimal or no change during usage.

The top surface 35 of the lid 34, as well as the rim/closure 36 are generally injection-molded components manufactured from thermoplastic materials, for example, polyethylene, ABS, polypropylene, etc. Cardboard and other similar materials can be utilized in lower life-expectancy designs. Suitable gasket materials include any elastomeric material that will retain its resilient conformable properties over time such as rubber, urethane, nitrile, foam, and the like.

Figure 6:
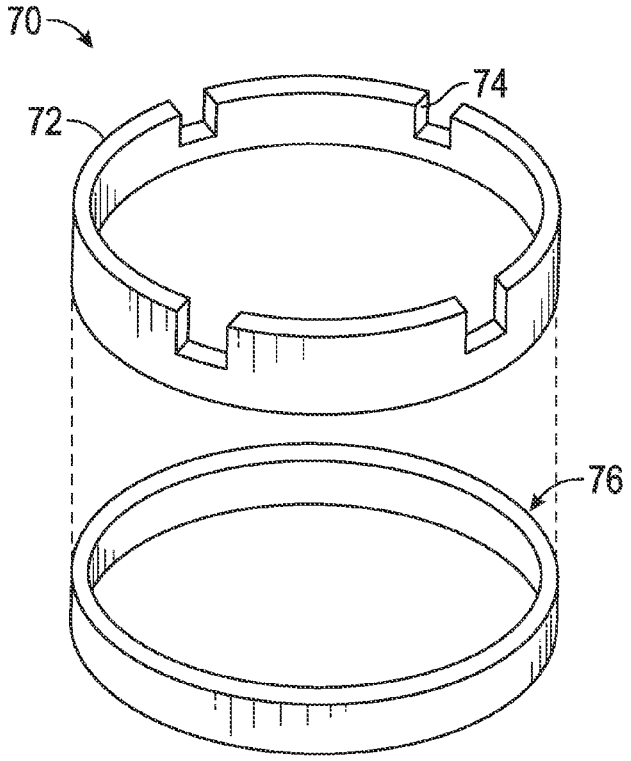
FIG. 6 illustrates an exploded view of a filter flange assembly in accordance with embodiments of the present disclosure.

FIG. 6 illustrates a further feature of the filter assemblies of the present disclosure, showing an exemplary filter rim assembly 70 for use with filter assembly 30. In accordance with this aspect of the disclosure, instead of, or in addition to, the gasket 38 surrounding opening 40, the filter assembly 30 may include a filter housing rim 76 which extends upward from the top surface 35 of the lid 34, and which mates with an annular filter rim 72 having slots, holes, or other shaped openings 74 for alignment with and attachment to the outlet tube of the vacuum appliance that extends down from the interior of housing cap 20.

Figure 7A:
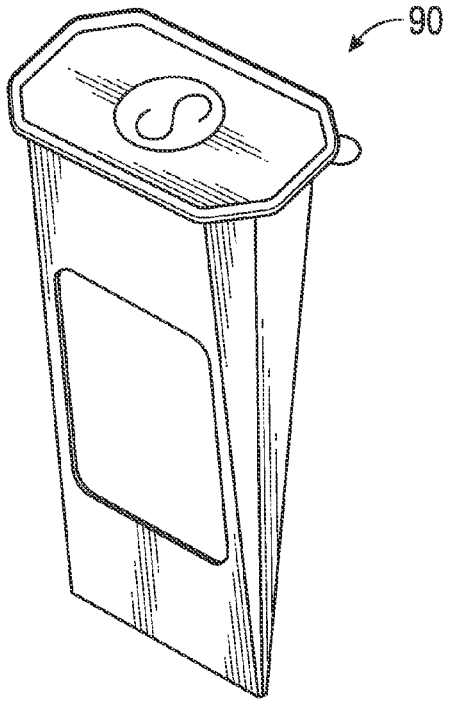
FIG. 7A illustrates perspective view of a filter assembly embodiment of the present disclosure.
Figure 7B:
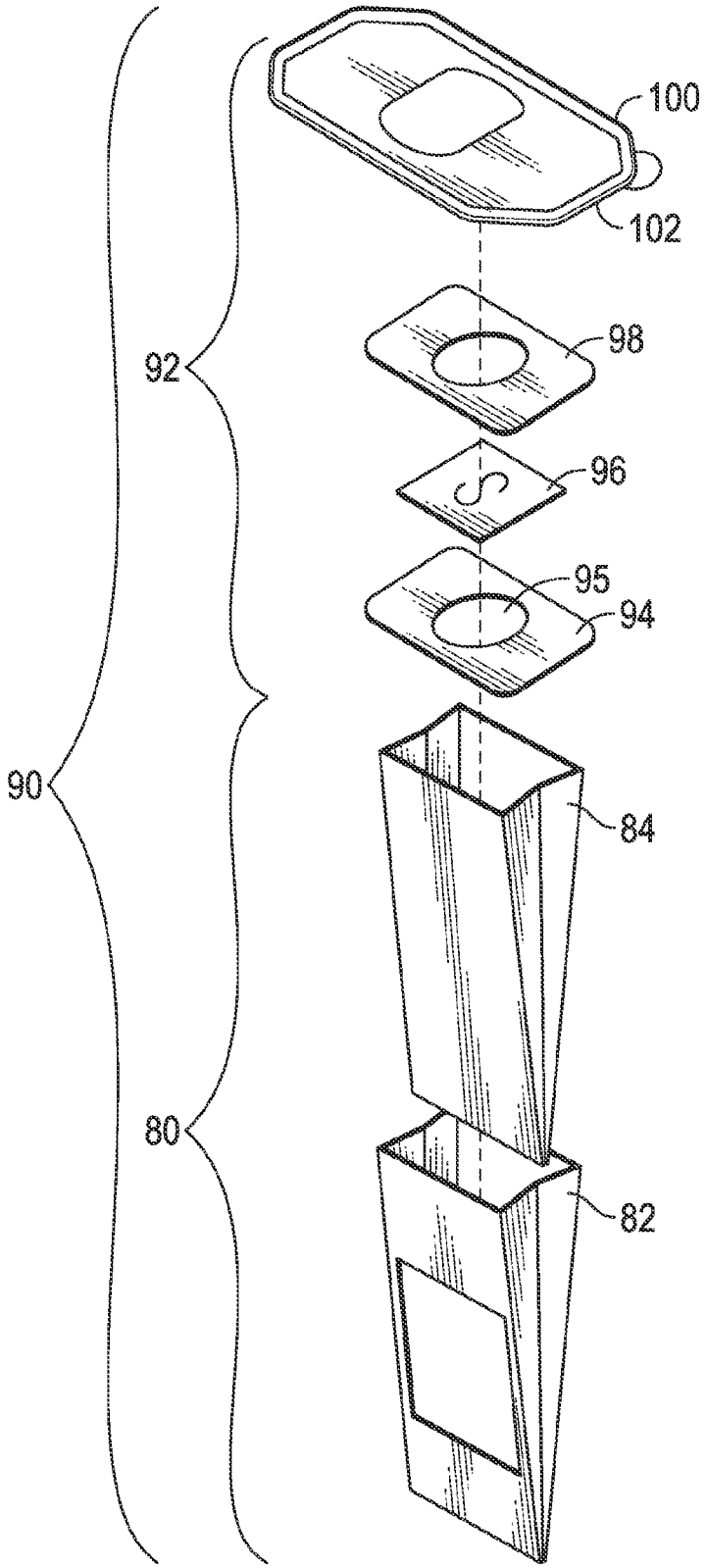
FIG. 7B illustrates an exploded view of the embodiment of FIG. 7A.
Figure 7C:
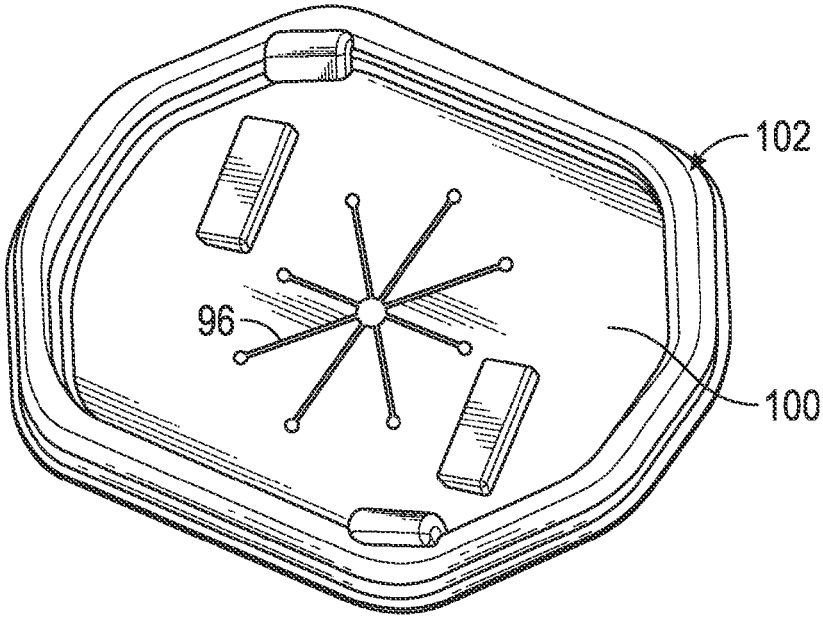
FIG. 7C illustrates a partial perspective view of an alternative filter assembly embodiment of the present disclosure.
Figure 7D:
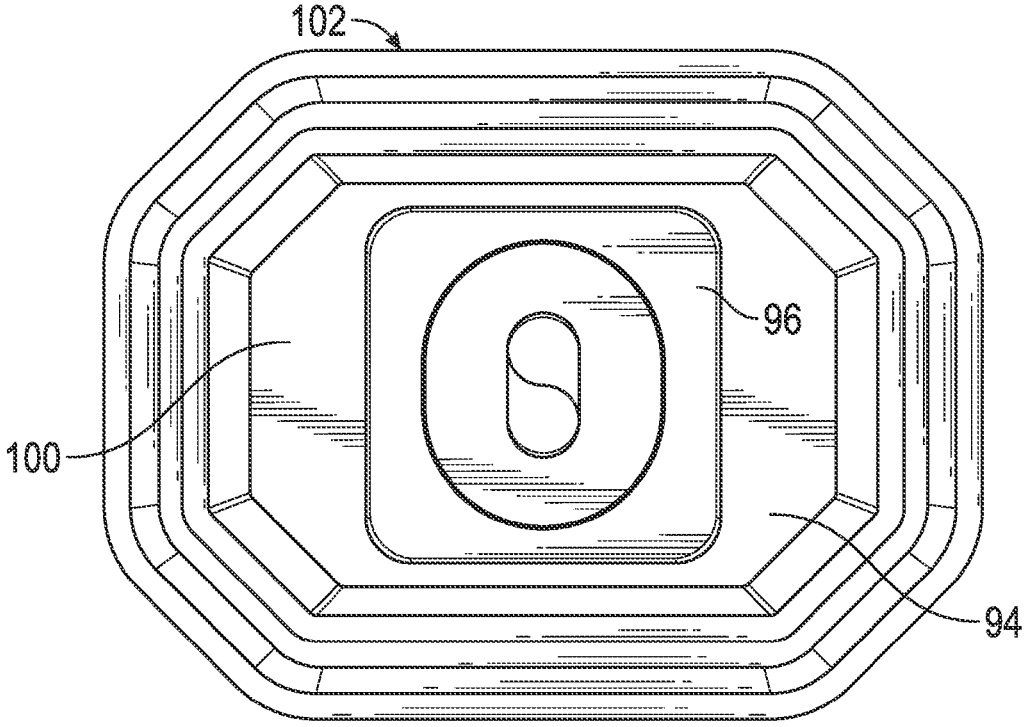
FIG. 7D illustrates a partial perspective view of another alternative filter assembly embodiment of the present disclosure.

FIG. 7A is a perspective view of an exemplary filter assembly 90 in accordance with the present disclosure. FIG. 7B is a schematic, exploded view thereof. The filter assembly 90 comprises a lower bag assembly 80 which includes outer sleeve 82, and inner liner 84. The filter structure permits fluid through-flow, such that the inner liner is made of a melt-blown material, and the outer sleeve is made of a material such as cellulose. The assembly 90 also comprises upper lid assembly 92 that includes a rubber or other elastomeric-material diaphragm 96 sandwiched between two collar pieces, top and bottom collars 98 and 94 (respectively), each of which have a central opening 95 cut therethrough. Collars 94,98 may be made from cellulose or some other fiberous material. As shown, the top collar 98 is further attached to a lid 100 having a surrounding rim, or closure, 102, which mates with the upper edge of vacuum container 12 in a manner similar to that described above. Some lid assemblies 92 may be simpler. For example, the diaphragm 96 may be incorporated into the lid 100, as shown in FIG. 7C, or sandwiched between the lid 100 and the bottom collar 94, as shown in FIG. 7D.

Figure 8A:
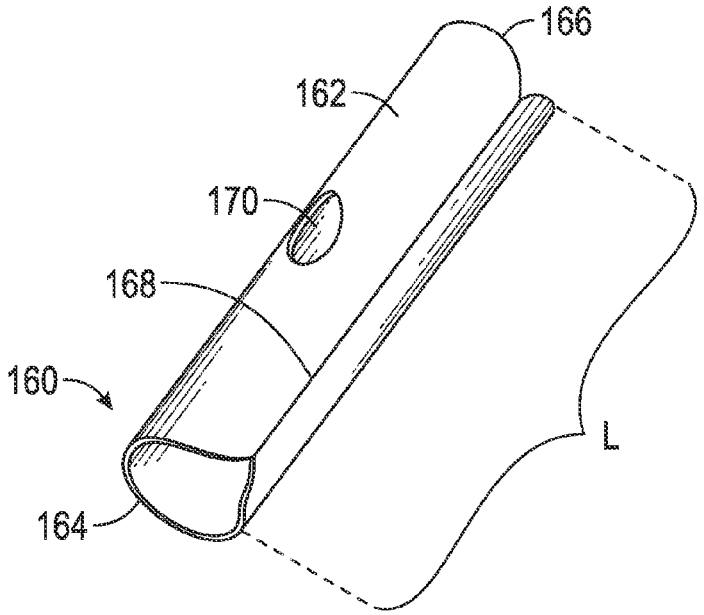
FIG. 8A illustrates an example bag closing clip in accordance with embodiments of the present disclosure.
Figure 8B:
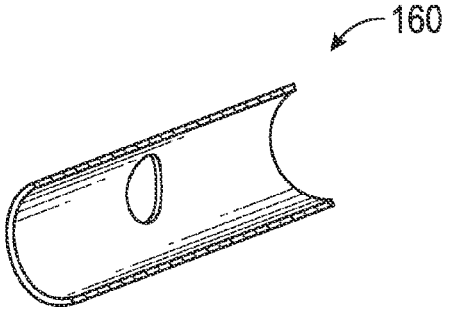
FIG. 8B illustrations a sectional view of the clip of FIG. 8A.

FIG. 8 illustrates a further embodiment of the present invention, for use with reusable filters having an open end to allow for the emptying of collected debris and subsequent reuse. Such reusable filter bag assemblies 130, including a filter bag 132 having an opening 133 in the bottom end, include a filter bag closure clip 160. The bag closure clip 160 has a hollow, shaped body 162 with opposite, (enlarged) open ends 164, 166 and a length "L" that is approximately the same width as the bottom end of filter bag 132. It will be appreciated that the length L of the closure clip 160 can be varied to accommodate any size and/or type of filter bag. It will also be appreciated that while the clip is shown to be generally in the shape of a hollow cylinder, other hollow shapes are envisioned, including but not limited to square, triangular, hexagonal, and octagonal cross-sectional shapes of the clip body 162. In accordance with select aspects of the present disclosure, the body 162 of clip 160 has a length L greater than its depth or width. The body of the clip 160 further includes a slot 168 that extends the entire length L of the body. In accordance with an aspect of this embodiment, slot 168 may be provided with a textured or gripping material on one or both edges of the slit so as to afford a gripping action on the end of the filter bag 132 engaged by the clip. Closure clip 160 can further include at least one orifice, 170, in the body 162 of the clip, which allows for a consumer to hold the clip 160 while a filter bag is inserted into the slot 168, without pinching and hindering the clips action by compressing the opposite edges of the slot together.

Closure clip 160 is preferably a rigid object, but in accordance with select embodiments it may be flexible or semiflexible. Clip 160 is preferably fabricated as a unitary body of plastic or similar polymeric material by injection molding or a similar process. Any plastic or polymeric material that is suitable for the end use of the closure clip 160 can be used in the manufacture of the clip.

Figure 9A:
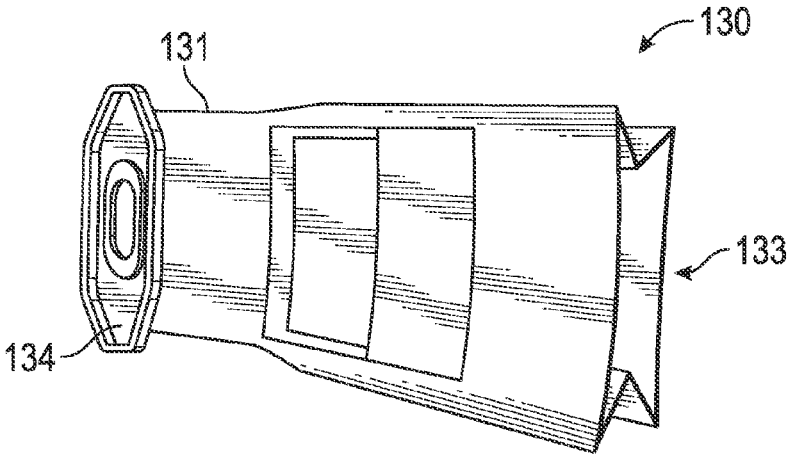
FIGS. 9A-9D illustrate the use of a vacuum bag clip in accordance with embodiments of the present disclosure.
Figure 9B:
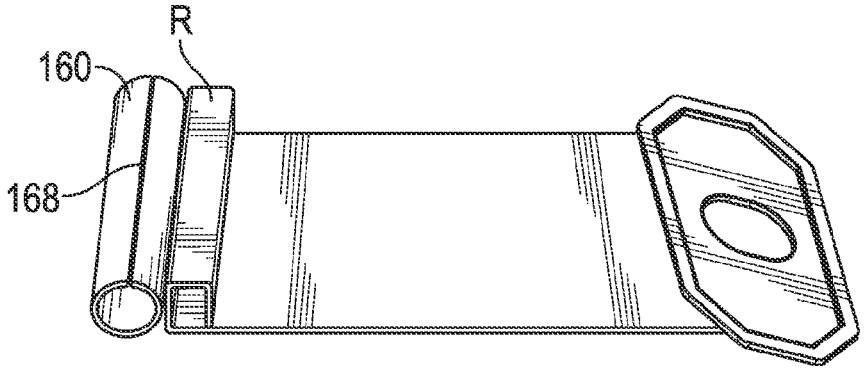
Figure 9C:
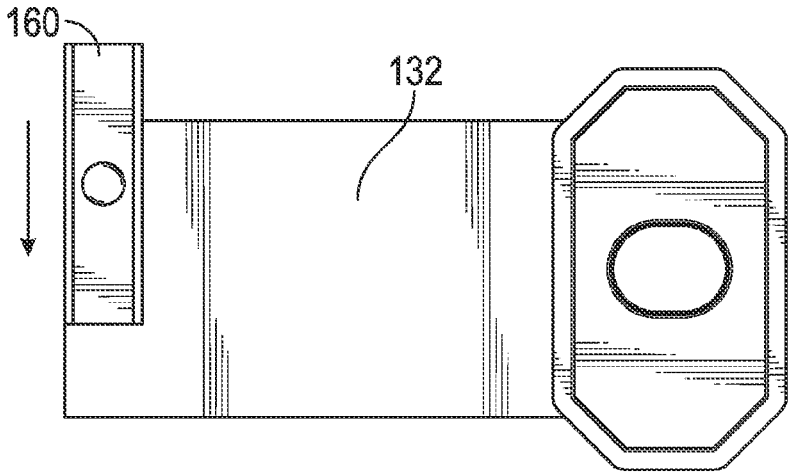
Figure 9D:
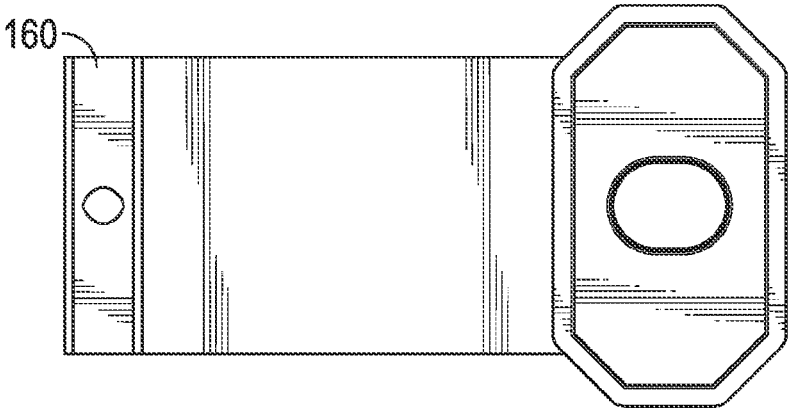

FIGS. 9A-9D illustrate the use of such a closure clip 160. In use of closure clip 160, a consumer opens the bottom end (opposite top end 131 attached to lid assembly 134) of a full filter bag 132 and discards the contents as appropriate. As shown in FIG. 9B, the user then compresses the sides of the filter 132 so as to close opening 133, and then folds the end of the filter over and upward towards the top of the filter bag at least one time, forming a roll, R. As shown in this figure, it is clear that closure clip 160 is substantially the same length, L, as the width of the filter bag 132. The consumer then slides the folded-over end of the filter bag 132 into the clip through slot 168, in a direction perpendicular to the bag itself, as illustrated by the arrows (FIG. 9C). During the step, the consumer may grasp the closure clip 160 via orifice 170 in the body of the clip so as to hold the clip in place (without squeezing or pinching it) while the bag 132 is inserted into the slot 168. As shown in FIG. 9D, upon completing the insertion of the closure clip 160 onto the filter bag, the clip acts to keep the end of the bag folded and sealed over in a closed manner, thereby allowing for the economical reuse of the filter assembly itself.

Figure 12A:
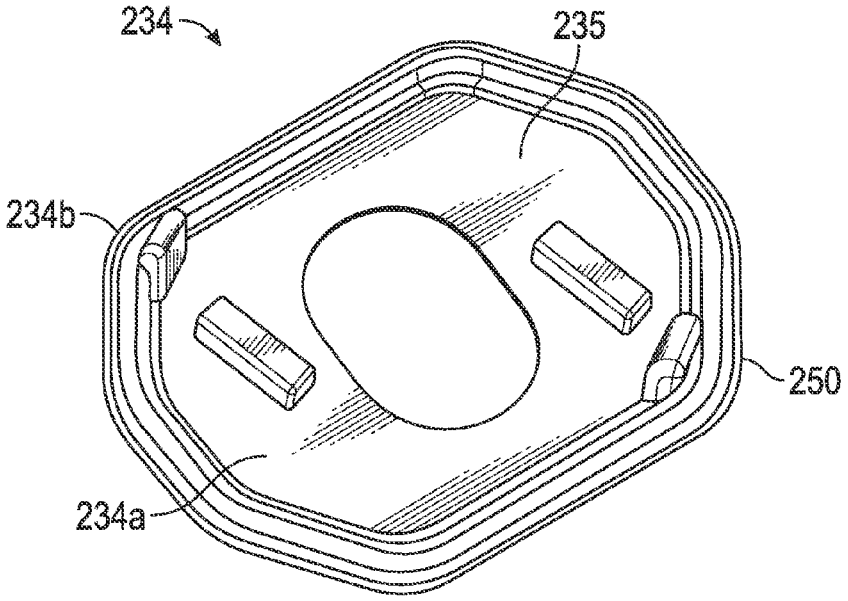
FIGS. 12A-12D illustrate select features of the filter bag assembly of FIG. 11.
Figure 12B:
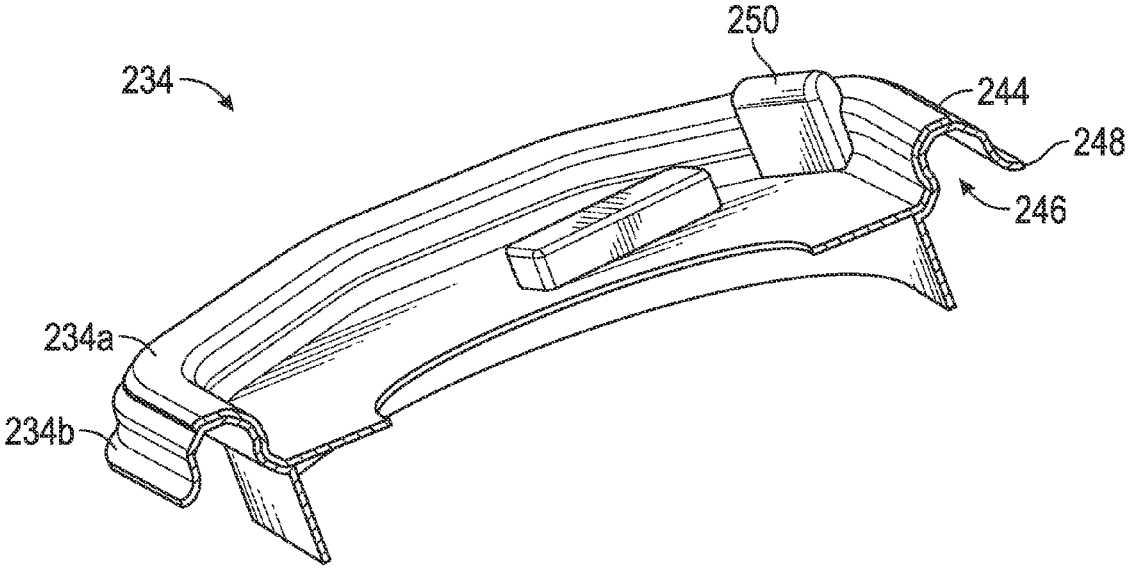
Figure 12C:
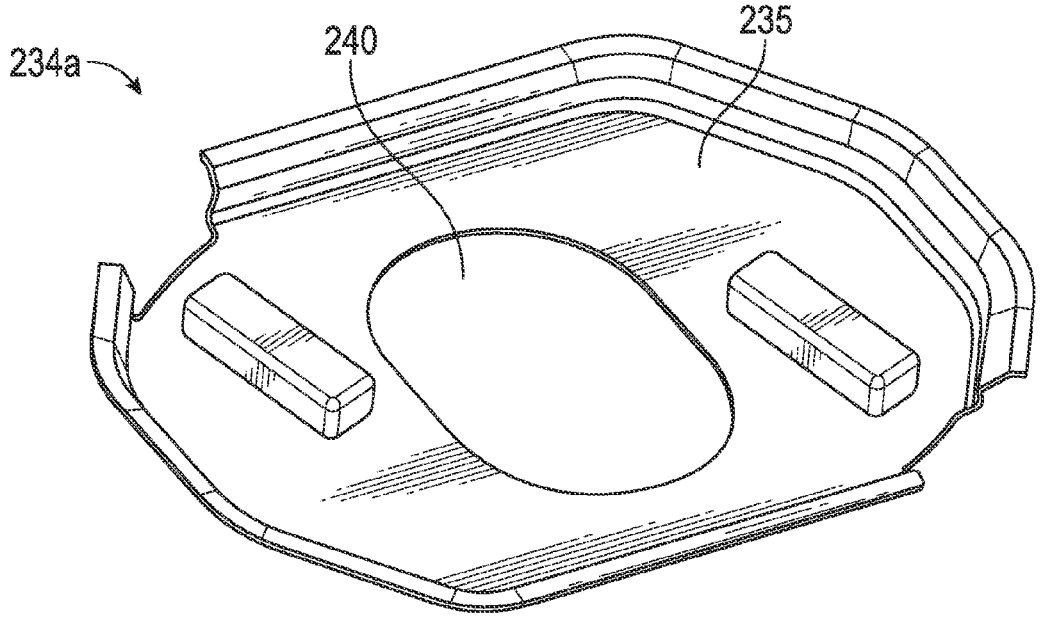
Figure 12D:
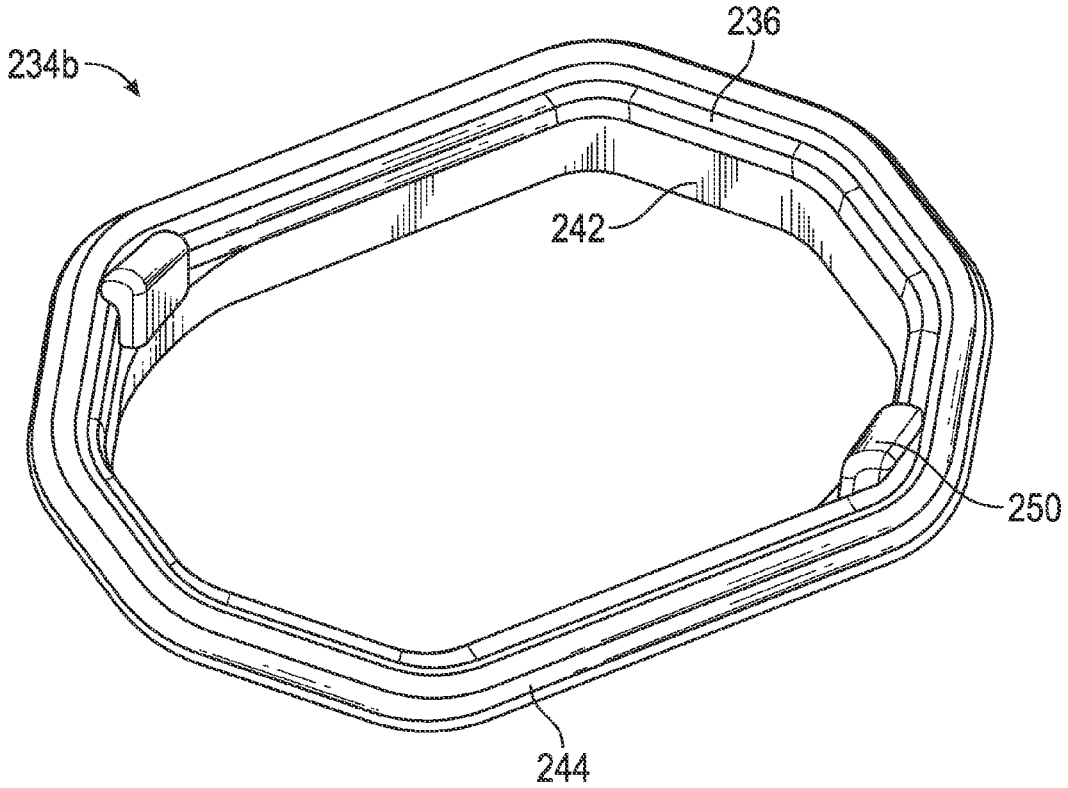

FIG. 11 illustrates a further embodiment of the present invention, for use with reusable filters having an open end to allow for the emptying of collected debris and subsequent reuse. These reusable filter bag assemblies 230, including a filter bag 232 having an opening 233 in the top end, include a two-piece lid 234. Referring also to FIGS. 12A, 12A, 12C, 12D, the lid 234 preferably includes a top piece 234*a* and a bottom piece 234*b*. The top piece 234*a* preferably includes the top surface 235 of lid 234 and the opening 240 for fluid communication of the vacuum air carrying debris into the filter bag 232. The top piece 234*a* may also include the diaphragm 96 sandwiched between one or more collar pieces 98,94 and/or the top surface 235.

The bottom piece 234*b* may include the surrounding closure 236 circumscribing the outer periphery of the bottom piece 234*b*. The closure 236 also preferably comprises a radial inner wall 242 and an opposite radial outer wall 244, together forming a channel 246 having an inverted U-shape. The outer wall 244 may further include an annular, outwardly-directed projection 248. Thus, the bottom piece 234*b* may also form the channel 246 to mate with the rim 50 in substantially the same manner as described above.

In any case, the filter bag 232 is secured to the bottom piece 234*b* by any of the methods discussed above, such as adhesive, stitching, and/or thermal welding. Thus, the top piece 234*a* may be removed from the bottom piece 234*b* to discard the contents of the bag 232. Then, the top piece 234*a* may be again mated to the bottom piece 234*b* and the filter bag assembly 230 replaced in the opening 13 of the housing 12 to continue operation of the vacuum.

The top piece 234*a* preferably mates with and seals to the bottom piece 234*b*. Thus, the top piece 234 preferably forms complementary shapes, as shown. For example, the top piece 234*a* preferably conforms to portions of the closure 236, such as portions of the radial inner wall 242.

Figure 13:
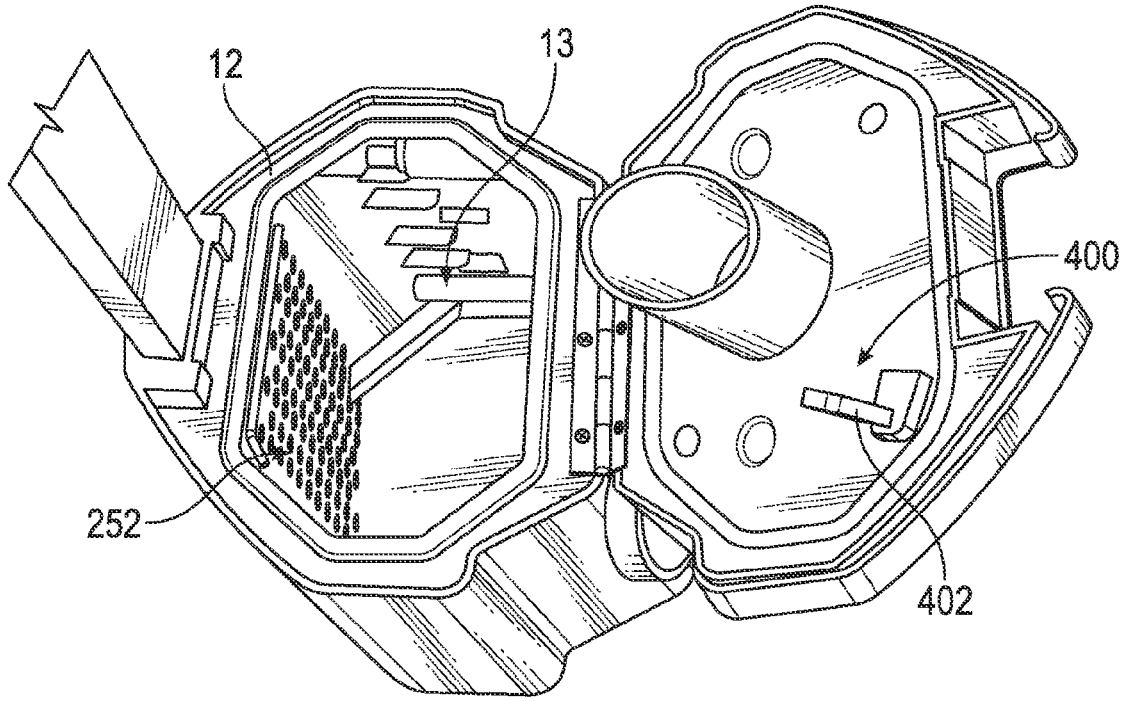
FIG. 13 illustrates a perspective view of an embodiment of a vacuum cleaner housing in accordance with certain aspects of the present disclosure.
Figure 14:
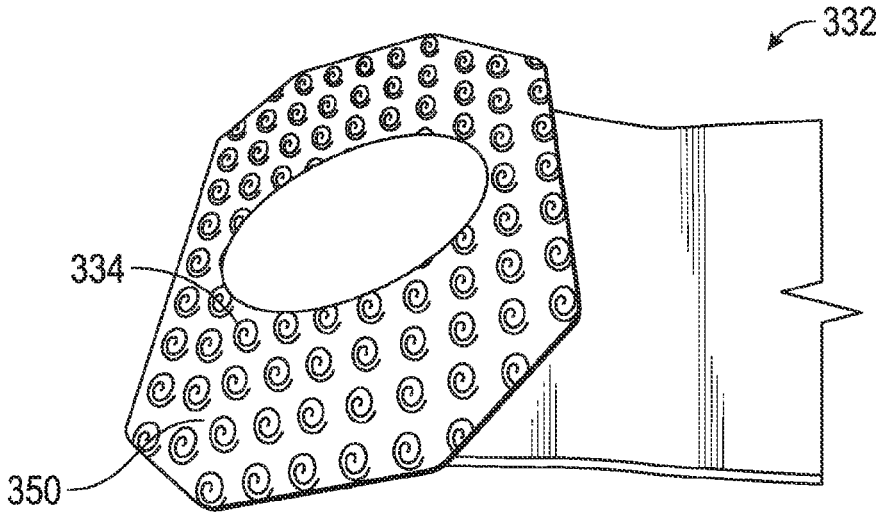
FIG. 14 illustrates a perspective view of an embodiment of a filter bag assembly in accordance with certain aspects of the present disclosure.

The lid 34,134,234 may also include one or more domes 250 that may be useful in properly aligning the lid with respect to the housing 12. Referring also to FIG. 13, the housing 12 may have complementary shaped protrusions 252 formed therein, adjacent the opening 13 therein. Referring also to FIG. 14, simpler filter bag assemblies 332, having substantially flat lids 334, may simply have cut-outs 350 to accommodate the protrusions 252, and therefore properly align the lid with respect to the housing 12.

Finally, the housing cap 20 may include an interlock 400, such as that shown in U.S. Pat. No. 2,742,105 incorporated herein by specific reference, that prevents the housing cap 20 from being closed or secured to the housing 12 and/or otherwise prevents operation of the vacuum when the filter bag assembly is not in place. For example, the interlock 400 may include a pivotally mounted arm 402 that engages the lid 34,134,234 and thus disengages the interlock, thereby allowing the housing cap 20 to close securely to the housing 12.

Other and further embodiments utilizing one or more aspects of the inventions described above can be devised without departing from the spirit of Applicant's invention. For example, the shapes of the lid assembly may be specifically designed to align with and mate with a specifically shaped filter compartment or housing for an upright vacuum. Further, the various methods and embodiments of the methods of manufacture and assembly of the system, as well as location specifications, can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A vacuum cleaner producing suction to lift debris and thereby clean a surface, the vacuum cleaner comprising:

a floor-engaging foot;

an upwardly-extending assembly pivotally mounted to the foot and including a housing defining a debris containment chamber having displaceable cover at one end;

a vacuum bag retainer formed on a top edge of a wall of the housing; and a filter bag shaped for installation within the debris containment chamber, the filter bag having a mounting plate attached at one end;

wherein the mounting plate mates with the vacuum bag retainer to form a substantially air-tight seal.

2. The vacuum cleaner of claim 1, wherein the filter bag is reusable.

3. The vacuum cleaner of claim 2, further including a clip secured to a bottom of the filter bag thereby closing the filter bag.

4. The vacuum cleaner of claim 2, wherein the mounting plate comprises two pieces, such that separation of the pieces permits the contents of the filter bag to be removed from the bag.

5. The vacuum cleaner of claim 1, wherein the mounting plate is mounted between the cover and the retainer.

6. The vacuum cleaner of claim 1, wherein the mounting plate includes a channel around its periphery.

7. The vacuum cleaner of claim 6, wherein an upper edge of the rim fits within the channel.

8. The vacuum cleaner of claim 1, wherein the mounting plate is rectangular.

9. The vacuum cleaner of claim 1, wherein the mounting plate is triangular.

10. The vacuum cleaner of claim 1, wherein the mounting plate is octagonal.

11. The vacuum cleaner of claim 1, wherein the mounting plate is an elongated octagonal shape.

12. The vacuum cleaner of claim 1, the mounting plate of the filter bag comprises:

a planar shaped lid having a top and bottom face;

an opening extending through the lid; and a perimetral, inverted U-shaped channel at the periphery of the top face of the lid and extending substantially entirely about the periphery thereof, the U-shaped channel being formed by a radial inner wall, a radial outer wall, and a top section interconnecting the inner and outer walls, such engages and seals to the retainer.

13. The vacuum cleaner of claim 1, wherein the filter bag includes at least one layer of paper.

14. The vacuum cleaner of claim 1, wherein the filter bag includes at least one region of transparent material for observing the contents of the filter bag.

15. The vacuum cleaner of claim 1, wherein the mounting plate includes at least one dome positioned to mate with at least one protrusion of the vacuum cleaner to align the plate therein.

16. The vacuum cleaner of claim 1, further including an interlock that prevents closure of the cover onto the chamber with the filter bag removed.

17. The vacuum cleaner of claim 1, wherein the filter bag is stitched to the mounting plate.

18. The vacuum cleaner of claim 1, wherein the filter bag is secured to the mounting plate via an adhesive.

19. The vacuum cleaner of claim 1, wherein the filter bag is thermally welded to the mounting plate.

20. The vacuum cleaner of claim 1, the mounting plate including an outwardly-directed projection for separation of the mounting plate from the retainer.

* * * * *